United States Patent [19]

Hoff et al.

[11] Patent Number: 4,793,398

[45] Date of Patent: Dec. 27, 1988

[54] HANGAR DOOR ASSEMBLY

[76] Inventors: Robert A. Hoff, Rte. 7 Box 170; John D. Hoff, Rte. 7 Box 171, both of Idaho Falls, Id. 83401

[21] Appl. No.: 1,823

[22] Filed: Jan. 8, 1987

[51] Int. Cl.[4] ..... E05D 15/26

[52] U.S. Cl. ..... 160/213; 160/190; 49/334

[58] Field of Search ..... 160/213, 206, 207, 189, 160/190, 188; 49/333, 334, 335, 199, 200

[56] References Cited

U.S. PATENT DOCUMENTS

| | | | |
|---|---|---|---|
| 1,356,346 | 10/1920 | Edholm | 49/333 X |
| 1,839,045 | 12/1931 | Moray | 160/190 X |
| 2,043,472 | 6/1936 | Eager et al. | 49/200 X |
| 2,238,181 | 4/1941 | Morgan | 160/213 X |
| 2,308,585 | 1/1943 | Bowsher | 160/190 |
| 2,523,929 | 9/1950 | Taylor | 160/190 |
| 2,889,875 | 6/1959 | Turner et al. | 160/188 |
| 2,936,830 | 5/1960 | Mosher | 160/188 |
| 3,289,740 | 12/1966 | Heier | 160/188 |
| 3,389,740 | 6/1968 | Buehler | 160/188 |
| 3,698,464 | 10/1972 | Scheitel | 160/188 |
| 4,088,172 | 5/1978 | Pollock | 160/207 X |
| 4,120,341 | 10/1978 | Doering | 160/213 |
| 4,124,055 | 11/1978 | Aspenson et al. | 160/193 |
| 4,243,091 | 1/1981 | DeVore | 160/207 X |
| 4,609,027 | 9/1986 | Keller | 160/213 X |
| 4,637,446 | 1/1987 | McQueen et al. | 160/213 X |

OTHER PUBLICATIONS

Photographs of Hangar Door Assemblies.

*Primary Examiner*—Ramon S. Britts
*Assistant Examiner*—David M. Purol
*Attorney, Agent, or Firm*—Price, Gess & Ubell

[57] ABSTRACT

An articulating door is fixed to a torque tube through a plurality of structural tube elements and gussets. The torque tube is rotatably fixed to the building. A sprocket, which is engaged to the torque tube, is driven by an electric motor and gear reduction drive, and a chain reduction drive. An arm assembly and counterbalance element counterbalance the door as it moves between its open and closed positions. In its open position, the door remains folded exteriorly of the building.

5 Claims, 2 Drawing Sheets

HANGAR DOOR ASSEMBLY

BACKGROUND OF THE INVENTION

1. Field of the Invention

The present invention relates generally to door assemblies and, more specifically, to an improved hangar door assembly.

2. Desription of Related Art

A continuing hazard in aircraft hangars and other large buildings has been the doors, which are of necessity large and heavy, covering the entrances and exits to such structures. The doors present hazards to an operator either opening or closing the doors, as well as persons that may be in the immediate area while the doors remain open or closed. Because of their heavy weight, the doors create a danger of inadvertently moving between their open and closed positions. A free swinging door, especially one being drawn downward by gravitational forces, could easily cause injuries to persons in the area. Furthermore, a bifolding door that is drawn up by cables and down by gravity is subject to inadvertent movement by cable or driving motor failure. The large size of the doors also present safety hazards in an environment of wind gusts, such as in airfields having aircraft hangars. The surface areas of the hangar doors create large areas of wind resistance. In the presence of frequent and strong wind gusts, the doors can be dislodged from their fully open or partially open positions and create a significant risk of injury to person and property.

The design of some of these doors also present space problems, particularly when the door must remain in an open position. Frequently, the size of the door is almost equal to that of a side of a building. In such case, if the door is disposed within the building while in an open position, a large amount of interior useable space is lost. If the door is designed to remain exteriorly of the building while open, the problem of wind gusts as noted above, then becomes a concern.

One example of a door assembly for large passageways is found in Aspenson, "Canopy Door," U.S. Pat. No. 4,124,055. Aspenson provides a series of cables, pulleys, and extendable struts to lift and lower the door. One problem with such a design is the apparent stress upon the pulley system which could become weakened by the weight of the door. A further drawback is the space which is taken up interiorly of the building structure when the door is in its fully open position.

Another example of a door for a large passageway is found in Doering, "Greenhouse Door Assembly," U.S. Pat. No. 4,120,341 wherein a handle is fixed centrally of the door with a trailing rope tied to one end of the handle. An operator uses the handle to lift and lower the door, as a pulley system and counter weights balance the weight of the door. The ability to open and close the door would appear to be inherently limited by the arm's reach of an operator. Another apparent problem is that the lower portion of the door appears to remain free swinging. This may present a risk of injury to the user and those in the vicinity.

Another design is disclosed in Heier, "Foldable Wall Assembly," U.S. Pat. No. 3,299,740. A foldable door, which is apparently relatively small, remains in a closed position interiorly of the housing structure and consequently presents the type of space problem described above. Buehler, "Door Operators," U.S. Pat. No. 3,389,740 discloses a door system that utilizes a pair of linkage arms connected to a shaft. The shaft is rotated by a swing arm that is connected to a follower and screw, the latter being rotated by an electric motor. A problem with this design is that it is apparently directed towards small, light-weight doors, such as that used for car garages.

A need still exists in the art for an improved door assembly that is effective in connection with large, heavy doors.

SUMMARY OF THE INVENTION

An object of the present invention is to provide an improved hangar door assembly.

Another object of the present invention is to provide a door assembly that is effective in connection with large, heavy doors.

A further object of the present invention is to provide a door assembly that minimizes the amount of space utilized while the door remains in either an open or closed position.

An even further object of the present invention is to provide a door assembly that is inherently safe by being balanced in all positions, thereby preventing sudden movement by the failure of opening and closing mechanisms and causing damage to property or injury to persons.

The objects of the present invention are particularly accomplished by a door having an upper panel and a lower panel, the upper panel being fixed to a building, each panel having an interior side. An assembly is used for articulating the upper panel with respect to the lower panel so that the interior sides of the panels can interface each other in varying degrees while entirely disposed exteriorly of the building. A torque tube is positioned on and along a transverse edge of a passageway in the building and operatively engaged to the door. An additional assembly is provided for rotating the torque tube, such assembly being engaged to the door. Another assembly is provided for counter-balancing the weight of the door, which assembly interfaces the torque tube.

These and other objects of the present invention can be seen from examination of the accompanying specification, claims, and drawings.

DESCRIPTION OF THE PREFERRED EMBODIMENT

The following description is provided to enable any person skilled in the mechanical field to make and use the present invention and sets forth the best mode contemplated by the inventors of carrying out their invention. Various modifications, however, will remain readily apparent to those skilled in the art since the generic principles of the present invention have been defined herein specifically to provide an improved hangar door assembly. Furthermore, although the following description of the preferred embodiments set forth in the context of airplane hangar structures, the present invention contemplates application in other contexts.

Figure 1:
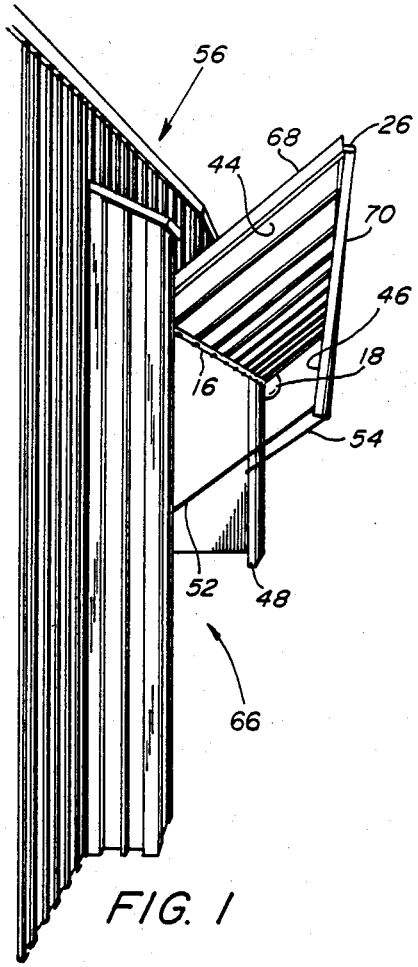
FIG. 1 is a perspective view of a portion of a hangar building supporting the present invention.

In FIG. 1, a building or hangar structure 56 is depicted and is constructed in any appropriate conventional design for the purpose of housing aircraft or other large equipment. The hangar structure 56 includes a support frame 48 which provides a passageway or hangar entrance 66 through which aircraft can enter or exit. A member or door 10 is rotatably fixed to the hangar structure 56 to close or leave open the hangar entrance 66. In this particular embodiment, the door 10 is preferably made of a corrugated, metallic element. The door 10, in this embodiment, weighs approximately 17,000 pounds and is approximately 100 feet in length and 22 feet in height. However, the present invention contemplates application for doors that weigh less or more than 17,000 pounds and are smaller or larger than 100 feet by 22 feet.

Figure 4:
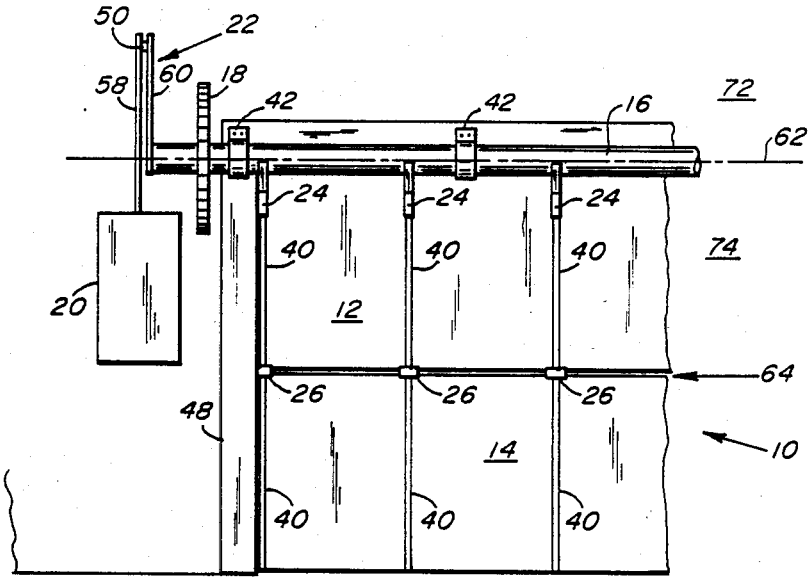
FIG. 4 is a partial, front view of the present invention.

The door 10 includes an upper panel 12 and a lower panel 14. The lower edge portion of the upper panel 12 and the upper edge portion of the lower panel 14, when viewed from FIG. 4, are rotatably fixed to each other along a hingeline 64 through a plurality of hinges 26. Each hinge 26 is of any appropriate conventional design that enables the upper panel 12 and the lower panel 14 to rotate or articulate with respect to each other, as in FIG. 2 shown in FIGS. 2A, 2B, 2C.

Figure 2A:
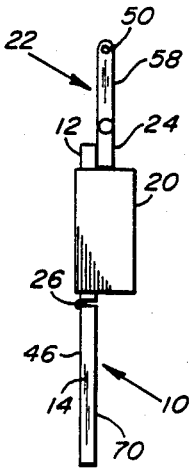
FIG. 2A depicts a portion of the present invention in a closed position.
Figure 2B:
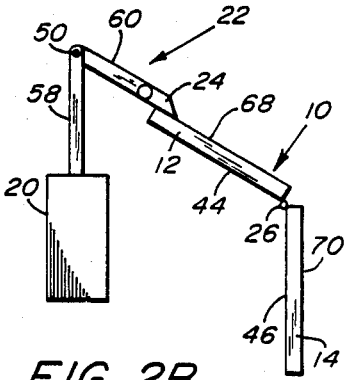
FIG. 2B depicts a portion of the present invention in a partially open position.
Figure 2C:
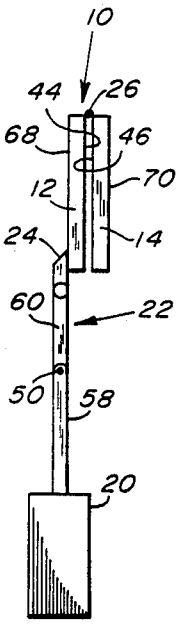
FIG. 2C depicts a portion of the present invention in a fully open portion.

Still referring to FIG. 2 FIGS. 2A, 2B, 2C, the upper panel 12 and the lower panel 14 have an interior face or side 44, 46, respectively, and an exterior face or side 68, 70, respectively. The interior faces 44, 46 are aligned seriatim and face the interior of the hangar structure 56 when the door 10 is in its closed position, as seen in FIGS. 2*a* and 4. As the door 10 is articulated, in the manner described below, into a fully open position (FIG. 2C), the interior sides 44, 46 are moved from a 180° angulation to 0°, at which point the sides are immediately facing each other.

A torque tube 16 serves to rotate the upper panel 12 and extends along the top or transverse edge of the frame 48, when viewed from FIG. 1. The torque tube 16 is an elongated, tube-shaped element preferably made of a rigid, metallic element. The particular strength of the material out of which the torque tube 16 is constructed will depend on the particular weight of the door 1 that must be rotated. The torque tube 16 extends along a longitudinal axis which describes a torque line 62. The torque tube 16 is rotatably fixed to the hangar structure 56 by a plurality of spaced apart hinges 42 (FIG. 4). The hinges 42 are of any appropriate conventional design t enable the torque tube 16 to be supported to the hangar structure 56 while rotating about the torque line 62, as described below.

The torque line 62 and the torque tube 16 delineate the surrounding space into a top area 72 and a bottom area 74. The top area 72 is defined generally as the area above the torque line 62, when viewed from FIG. 4. The bottom area is defined generally as the area below the torque line 62, when viewed from FIG. 4.

Figure 5:
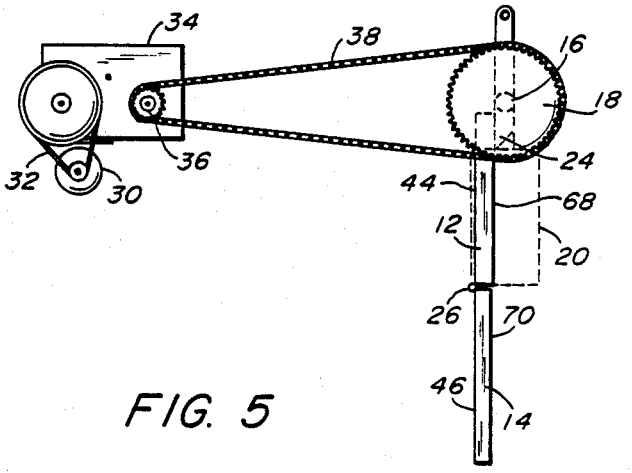
FIG. 5 is a partial, side view of the present invention that depicts the driving source.

In this preferred embodiment, a sprocket 18 is fixed near one end of the torque tube 16 to rotate the torque tube 16. The sprocket 18 is of any conventional design and includes a plurality of alternating teeth and grooves spaced about its circumferential edge. The sprocket 18 is preferably made of a metallic element of sufficient strength to transmit a rotating, drive force directly to the torque tube 16. Referring to FIG. 5, an electric motor and gear reduction drive 30 provide a driving force which is increased by a drive belt 32 and a chain reduction drive box 34. The chain reduction drive box 34 produces an output drive to a sprocket 36. The sprocket 36 transmits the drive force through a drive chain 38 which engages the sprocket 18. The aforementioned elements provide a rotating force to the sprocket 18, which force is then transferred to the torque tube 16. The present invention, however, contemplates that the sprocket 18 can be driven with effectiveness by various mechanisms other than the electric motor 30 and the drive box 34. The present invention further contemplates that, depending on the weight of the door 10, a sprocket 18 can be provided at both ends of the torque tube 16 with appropriate driving mechanisms to provide greater driving force to the torque tube 16.

An arm assembly 22 assists in counterbalancing the weight of the door 10 as it moves between its open and closed positions. The arm assembly 22 is stationarily fixed at the end of the torque tube 16 adjacent the sprocket 18 and includes a first arm 58 and a second arm 60, each of which is a flat, elongated element. In this particular embodiment, the first arm 60 is shorter in length than the second arm 58 and has one end thereof fixed to the end of the torque tube 16. The other end of the first arm 60 is rotatably connected to one end of the second arm 58 through a spindle element 50.

The opposite end of the second arm 60 is fixed to a counterbalance element or weight 20. The counterbalance element 20 is approximately equal in weight to the combined weight of the upper panel 12, the lower panel 14, and the gusset assemblies 24 which are described below. In the event that more than one sprocket 18 is provided, additional counterbalanced elements 20, arm assemblies 22, and the other driving elements can be provided with respect to each sprocket 18.

A plurality of equally spaced apart, vertically extending structural tube elements 40 are rigidly fixed on the exterior faces 68, 70 of the upper panel 12 and the lower panel 14, respectively, when viewed from FIG. 4. The tube elements 40 on the upper panel 12 assist in transferring the rotating movement of the torque tube 16 to the upper panel 12. The elements 40 on the lower panel 14 provide structural integrity. Each tube element 40 is a rigid, elongated element which, in this embodiment, extends from the top edge to the bottom edge of each panel, when viewed from FIG. 4.

Figure 3:
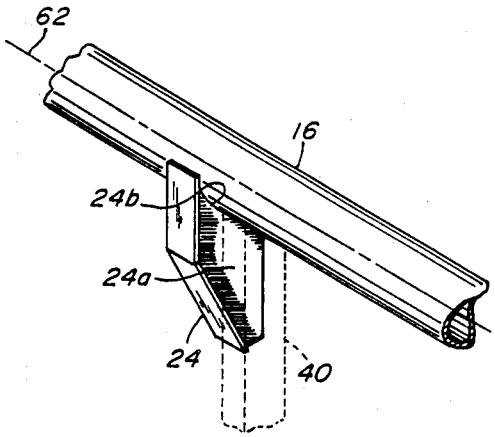
FIG. 3 is a perspective view of the torque tube, the gusset, and the structural tube element of the present invention.

A plurality of equally spaced apart gusset assemblies are preferably welded intermediate the torque tub 16 and each of the structural tube elements 40. Each gusset assembly 24 (FIG. 3) includes a channel 24*a* and an arc portion 24*b*. The channel 24*a* is configured and dimensioned to stationarily engage a portion of the structural tube element 40. The arc portion 24*b* is configured and dimensioned to stationarily engage a portion of the torque tube 16. Thereby, each gusset assembly 24 transmits the rotating force of the torque tube 16 to a respective structural tube element 40.

A pair of stabilizer rods 52, 54 are provided to stabilize the movement of the lower panel 14 as the door 10 is articulated. Each rod 52, 54 is an elongated, rod shaped element. One of the rods 52, 54 is rotatably fixed at each of the lower corner portions of the lower panel 14, when viewed from FIG. 5. The ends of the rods 52, 54 opposite the lower panel 14 are rotatably fixed to the lateral sides of the support frame 48. The stabilizer rods 52, 54 prevent the lower panel 14 from freely swinging and causing injury to a person as the door 10 moves between its open and closed positions.

The operation of the present invention is depicted in FIG. 2. In FIG. 2A, the present invention is in its closed position whereby the hangar entrance 66 is closed. In such a position, the upper panel 12 and the lower panel 14 are in the bottom area 74 and remain in an unarticulated position. To move the door 10 into its open position, the electric motor and gear reduction drive 30 are placed into an operable state. The driving force thereby produced is increased through the reduction drive box 34. The reduction drive box 34 produces an output drive through the sprocket 36 which is then transmitted to the sprocket 18. The sprocket 18 thus rotates and, in turn, rotates the torque tube 16.

Because the upper panel 12 is stationarily fixed to the torque tube 16 through the structural tube elements 40 and the gusset assemblies 24, the upper panel 12 rotates with the torque tube 16 about the torque line 62. As the upper panel 12 rotates about the torque line 62, the lower panel 14 then moves in an upwardly direction, when viewed from FIG. 2, and becomes articulated with respect to the upper panel 12 about the hingeline 64. The hinges 26 enable the upper panel 12 and the lower panel 14 to become increasingly articulated with respect to each other. At the same time, the arm assembly 22 is rotated by the torque tube 16 and the arms 58, 60 become articulated. The counterbalance element 20 moves in an downwardly direction and also about the torque line 62 as the torque tube 16 continues to rotate. The counterbalance element 20 thereby provides a counterbalancing weight to the door 10 and assists in stabilizing and moving the door 10 to its open position. In its fully open position (FIG. 2C), the upper panel 12 and the lower panel 14 are entirely in the top area 72 exteriorly of the hanger 56. The panels are then generally parallel to one another, and the interior faces 44, 46 are positioned immediately opposite each other. To move the door 10 from its open position to its closed position, the operation of the elements described above are reversed.

The specification above describe only one preferred embodiment of the present invention, and it is contemplated that various modification to the above can be effected but nevertheless come within the scope of the invention as defined by the claims.

What is claimed is:

1. An improved airplane hangar, comprising:

a housing assembly describing a passageway; and a door assembly for opening and closing the passageway, the door assembly including:

a door having an upper panel and a lower panel, the door fixed at the passageway along a torque line, the torque line delineating a top area above the torque line and a bottom area below the torque line, the door capable of moving between a closed position and a fully open position, the fully open position described by the upper panel and the lower panel disposed entirely in the top area exteriorly of the housing assembly while the upper panel and the lower panel are in substantially vertical orientations;

hinge means for articulating the upper panel and the lower panel relative to each other, the hinge means being fixed between the upper panel and the lower panel;

a torque tube extending along the torque line and directly and contiguously fixed to an upper transverse edge of the upper panel;

at least one sprocket element directly affixed to an end of the torque tube;

at least one rotating means for rotating the sprocket element and thereby the torque tube and the upper panel, such rotation causing the lower panel to move in a vertical direction while remaining in a vertical orientation;

an arm assembly having a first arm and a second arm positioned in an end to end relationship, the first arm being engaged to the end of the torque tube;

at least one counterbalance element engaged to the second arm; and at least one stabilizing rod rotatably fixed between the door and the housing assembly which prevents swinging of the lower panel without lifting it.

2. The invention of claim 1 further comprising:

at least one structural tube element fixed to the door; and at least one gusset intermediate the door and the structural tube element.

3. The invention of claim 1 wherein the rotating means includes an electric motor, a gear reduction drive, and a chain reduction drive.

4. The invention of claim 1 wherein the stabilizing rod is rotatably engaged to the bottom panel.

5. The invention of claim 4 wherein there are two stabilizing rods.

* * * * *